United States Patent [19]

Thomas

[11] Patent Number: 4,487,293

[45] Date of Patent: Dec. 11, 1984

[54] ELEVATOR/HATCH CONTROLLER PLATFORM LEVELING LOGIC WITH SAFETY FEATURES

[75] Inventor: Geoffrey O. Thomas, Bethesda, Md.

[73] Assignee: The United States of America as represented by the Secretary of the Navy, Washington, D.C.

[21] Appl. No.: 478,592

[22] Filed: Mar. 24, 1983

[51] Int. Cl.[3] ..... B66B 1/18

[52] U.S. Cl. ..... 187/29 R; 340/19 R; 340/20; 340/21

[58] Field of Search ..... 187/29, 29 R

[56] References Cited

U.S. PATENT DOCUMENTS

| | | | |
|---|---|---|---|
| Re. 29,543 | 2/1978 | Glaser | 187/29 R |
| 3,581,915 | 6/1971 | Saul | 187/29 X |
| 3,625,311 | 12/1971 | Nowak | 187/29 R |
| 3,857,465 | 12/1974 | Iwasaka et al. | 187/29 R |
| 4,304,319 | 12/1981 | Radke | 187/29 R |

*Primary Examiner*—B. Dobeck
*Assistant Examiner*—Paul Shik Luen Ip
*Attorney, Agent, or Firm*—Robert F. Beers; William T. Ellis; Charles E. Krueger

[57] ABSTRACT

An elevator levelling/hatch control circuit including a motor controller, an elevator dispatching unit, an elevator location sensing unit, and a control unit. The control unit receives hatch position signals, monitors the speed and direction of elevator motion and generates hatch open/close commands and elevator speed and direction commands to assure safe elevator operation in a shipboard environment. In one embodiment the circuit utilizes miniature electromechanical relays that may be visually monitored and easily tested.

12 Claims, 8 Drawing Figures

ELEVATOR/HATCH CONTROLLER PLATFORM LEVELING LOGIC WITH SAFETY FEATURES

BACKGROUND OF THE INVENTION

1. Field of the Invention

The present invention relates to control systems and more particularly to an automatic elevator control system.

2. Description of Prior Art

Older vesions of shipboard elevator control systems use large relays coupled with generally unreliable mechanical limit switches. More recent control systems use proximity switches with solid state logic controllers. While the old systems have reliability problems, the newer systems are difficult to troubleshoot and repair parts are expensive and difficult to obtain. In addition, there is a need for additional safety and automatic control features not presently available. In particular, two safety problems with existing systems are: (1) in a system with a two-speed motor controller, the failure of a stop switch in the elevator trunk often results in the controller commanding the high-speed contactor to pull in when the platform destination has been passed and the elevator is in a portion of the trunk not covered by leveling sensors, and (2) upon the failure of a platform sensing switch, existing elevator platform logic circuitry frequently will stop the platform at the extreme of travel in the direction of the dispatch, but not immediately at intermediate levels when the failure is recognized. Additionally, the open elevator trunk of existing systems poses a fire hazard.

OBJECTS OF THE INVENTION

Accordingly, it is an object of the invention to simplify the circuitry of an elevator control system for facilitating troubleshooting and repair.

It is a further object of the invention to include automatic safety features for the protection of personnel and equipment.

It is still a further object of the invention to automatically seal off the elevator trunk to prevent the spread of fire.

It is still a further object of the invention to deactivate the high-speed contacter in the event of a stop switch failure.

It is still a further object of the invention to stop the elevator as soon as possible if an elevator stop sensing switch failure should occur.

SUMMARY OF THE INVENTION

The above and other objects are realized in the present invention which comprises an elevator dispatching unit and an elevator location sensing unit interconnected with a control unit. The control unit is also interconnected with a motor controller including up, down, high-speed and low-speed inputs and with a dual-hatch controller including hatch open and hatch close inputs. The control unit receives information pertaining to dispatch destination, elevator location, speed, direction, and hatch condition, and generates elevator direction and speed control signals and hatch control signals. The system utilizes miniature electromechanical or solid-state relays which may be visually monitored and easily repaired. The system logic keeps at least one hatch closed at all times for sealing the elevator trunk and increasing safety. Additionally, the relays are interconnected so that if an elevator sensing stop switch fails, then the elevator high-speed control can not be reenergized, and the platform will stop at the next sensing switch in the direction of travel. This also insures that the platform can only be dispatched to preselected locations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
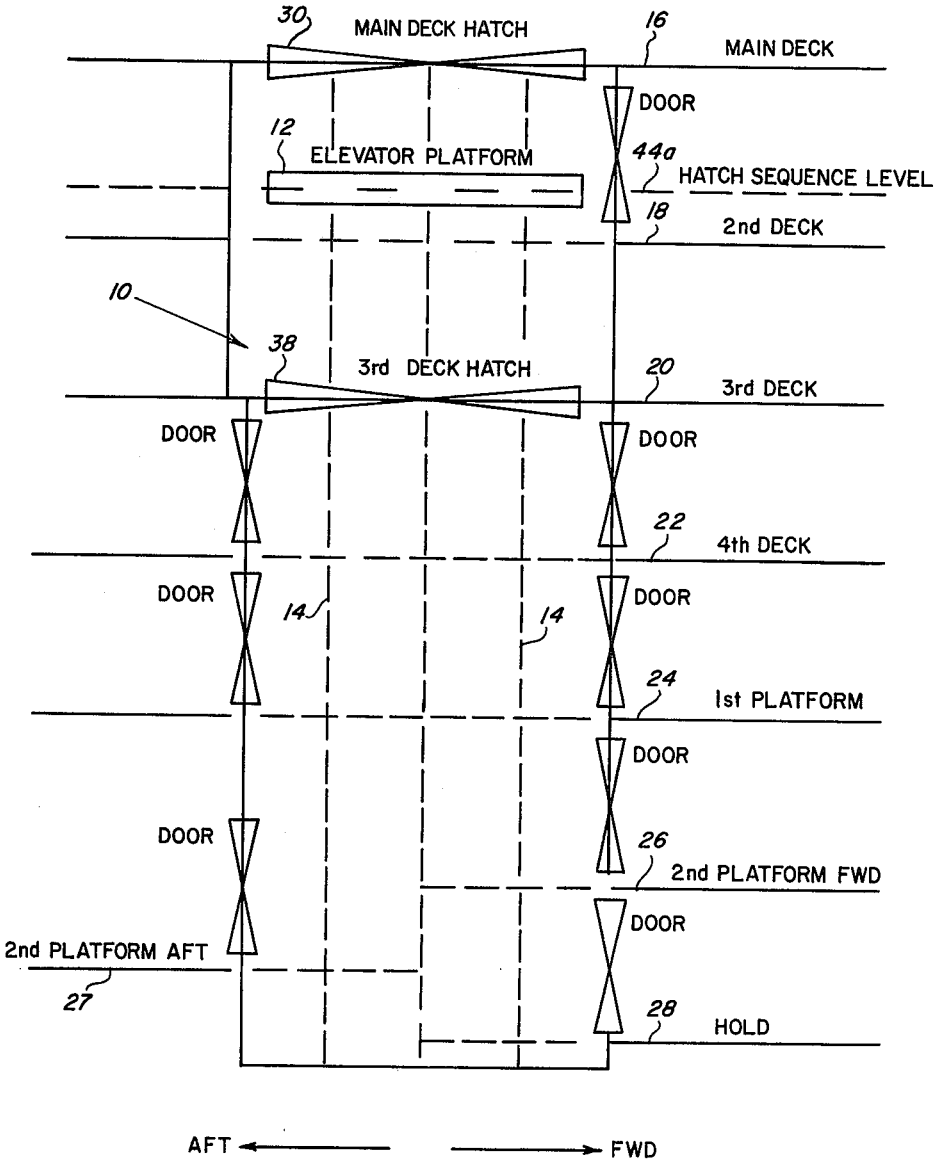
FIG. 1 is a diagrammatic side view of an elevator system with which the control system of the present invention is used.
Figure 2:
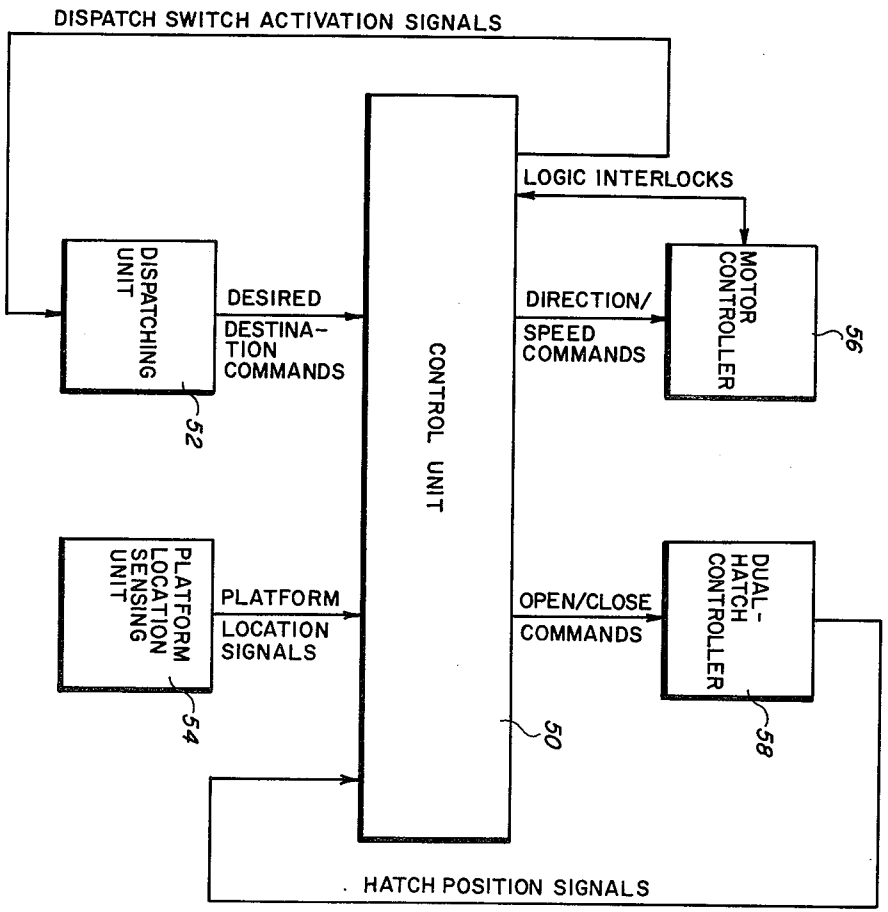
FIG. 2 is a block diagram illustrating the overall functioning of the invention.

The present invention is an elevator levelling/hatch controller logic system for use with a weapons or equipment elevator aboard ship. The system operates the elevator and the hatch controllers to implement desirable safety conditions. The layout of the elevator, trunk, decks and hatches is illustrated in FIG. 1. FIG. 2 is a block diagram of the invention, while FIG. 3 is a circuit diagram of a preferred embodiment.

Referring now to the drawings, wherein like reference numerals designate identical or corresponding parts throughout the several views, and more particularly to FIG. 1 thereof, a shipboard elevator system is depicted. The elevator system includes an elevator trunk 10 within which an elevator platform 12 travels. The elevator platform 12 is raised and lowered on guides 14 and operates to service the various decks and platforms including the main deck 16, second deck 18, third deck 20, fourth deck 22, first platform 24, second platform forward 26, second platform aft 27, and hold 28. A main deck hatch 30 is positioned to seal off the trunk 10 when closed. The main deck hatch 30 is controlled by a dual-hatch controller with main deck hatch open and close inputs. A third deck hatch 38 is controlled by the same dual-hatch controller, with third deck hatch open and close inputs. A hatch sequence level 44*a* is positioned between the main and third decks.

FIG. 2 is a block diagram of the invention. Referring now to FIG. 2, a control unit 50 is interconnected with a dispatch unit 52 including dispatch stations at the main deck hatch and at each door, a platform location sensing unit 54, a motor controller 56, and a dual-hatch controller 58. The control unit 50 receives input signals indicating elevator destination, and elevator location. The control unit 50 utilizes this input information to generate control signals for the motor controller 56 and dual-hatch controller 58. These control signals are generated in response to the various inputs received and insure safe operation of the elevator. The various safety features incorporated into the control unit are described in detail below.

The hatch controller 58 and motor controller 56 are not part of the present invention. The hatch controller includes hatch close and hatch open inputs activated by relays controlled by the control unit 50. The motor controller 56 includes up, down, high-speed and low-speed inputs for activating the coils of magnetic contactors in the master controller. These inputs are also activated by relays controlled by the control unit 50.

FIGS. 3A–3F represent a circuit diagram of a preferred embodiment of the present invention. Before considering the details of FIGS. 3A–3F the following overview of the control requirements is presented for better understanding. Generally, dispatch of the elevator is only possible from the level at which the elevator is stationed. Certain exceptions are detailed later. During travel between lower decks, the third deck hatch is open and the main deck hatch is closed. If the elevator is dispatched from a lower deck to the main deck it first stops at the hatch sequence position between the main deck and third deck. Next the third deck hatch is closed and the main deck hatch is opened. Finally, the elevator proceeds to the main deck. Similarly, when dispatched from the main deck, the elevator stops at hatch sequence while the main deck hatch closes and the third deck hatch opens. This hatch sequencing prevents objects or fluids which may cause a fire from falling into the lower decks of the ship since the main deck hatch and the third deck hatch are never simultaneously open.

Figure 3A:
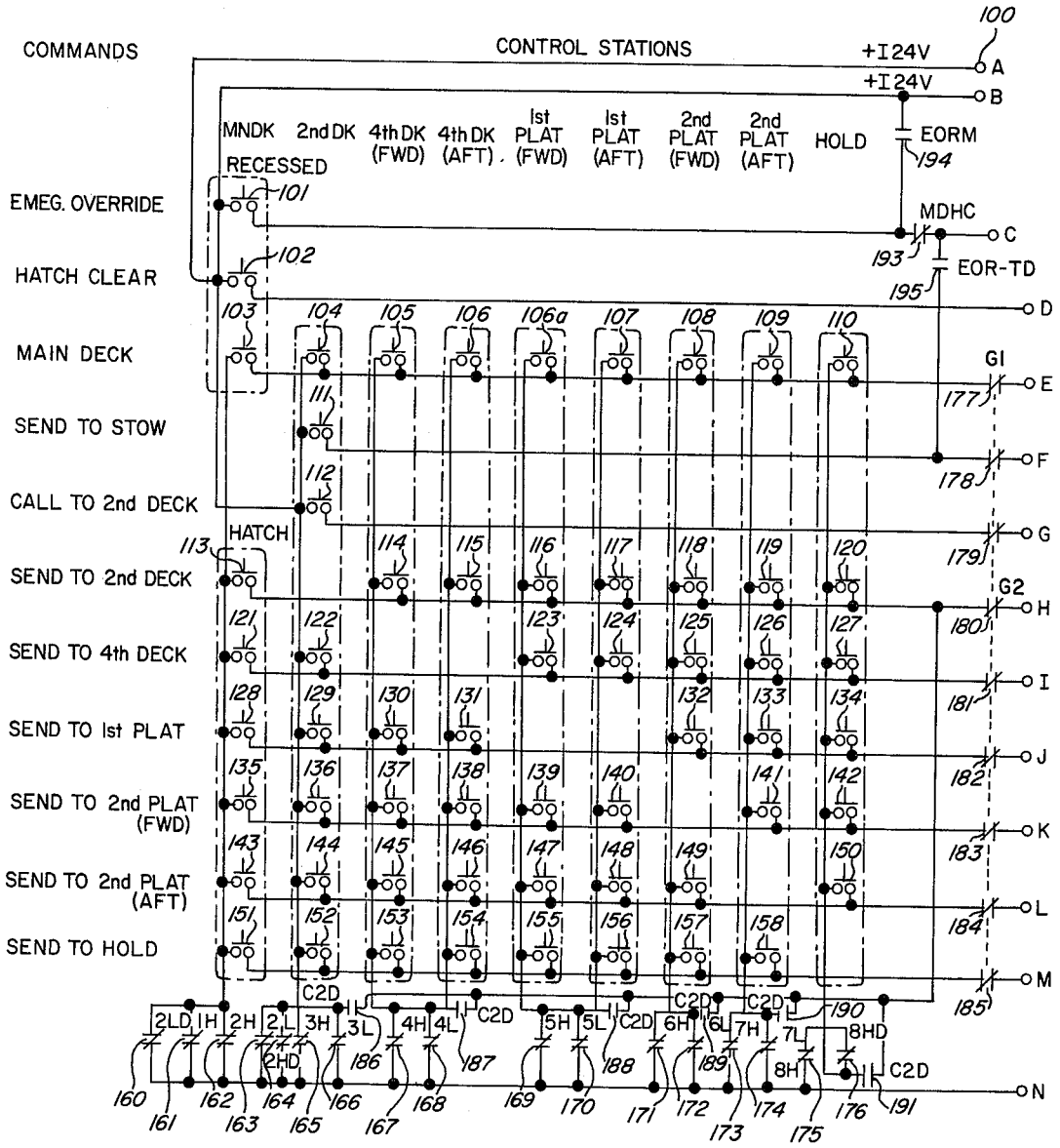
FIGS. 3A–3F are schematic circuit diagrams of one embodiment of the invention.
Figure 3B:
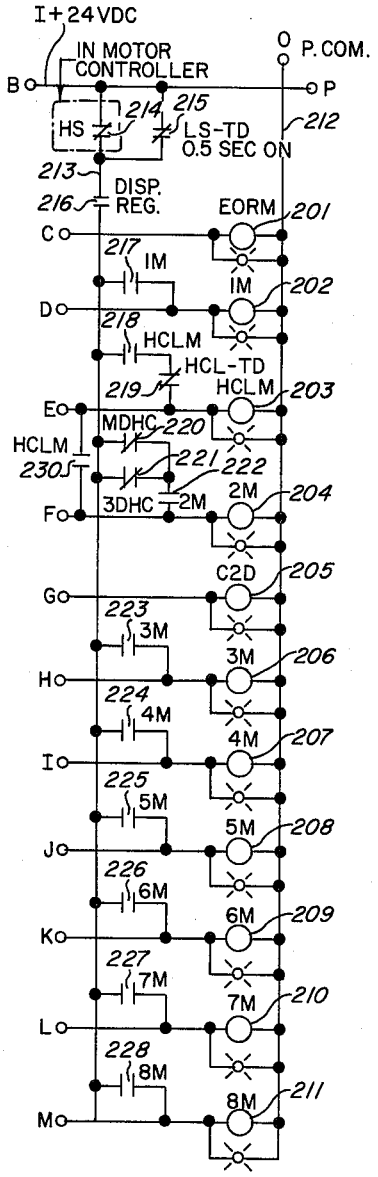
Figure 3C:
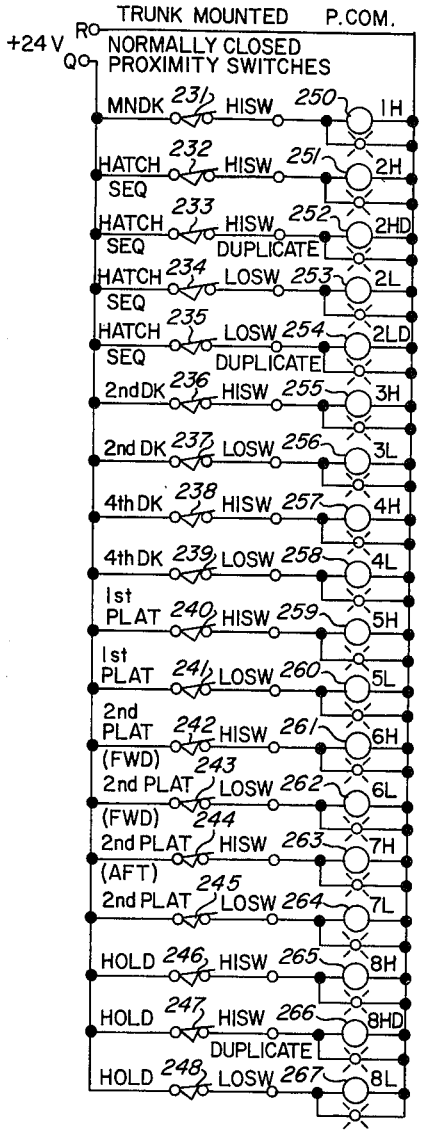

The circuits depicted in FIGS. 3A–3F include relays and switches. The dispatch switches and elevator proximity switches are depicted in FIGS. 3A and 3C, respectfully.

The relays have their coils identified by circles and their contacts identified by two parallel and spaced apart lines. A normally closed relay contact has an oblique line across the parallel lines and a normally open contact has no such oblique line. It should be noted that the coil and contacts associated with a particular relay are always separated from each other in the drawing symbols. Each relay coil is wired in parallel with an indicator light that is on when the coil is activated. These indicator lights are identified by a small circle with four lines radiating therefrom. The relays used in an actual circuit are six pole double throw (6 PDT) electromechanical relays.

FIGS. 3A–3F are sections of a complete circuit diagram of the system. Each figure includes several input and output terminals 100 labeled by capital letters. The complete circuit is formed by connecting the terminals labeled with the same letter.

FIG. 3A is a circuit diagram of dispatch unit 52, FIG. 2. A plurality of dispatch switches 101–158 and relay contacts 160–195 form a grid for selectively energising output terminals C–M at +24 V.

FIG. 3B is a diagram of the dispatch destination memory circuit of the control unit. Note that the input terminals C–M are connected to the output terminals C–M of FIG. 3A. Eleven relay coils 201–211 connect the inputs C–M to a power supply common line (p—com) 212. In addition the relay coils 201–211 are connected to a dispatch-set line 213 by a plurality of relay contacts 214–228. Note that HCLM relay contact 230 connects input E to input F.

FIG. 3C is a circuit diagram of the elevator location sensing unit 54, FIG. 2. This unit comprises a plurality of proximity switches 231–248 and H and L relay coils 250–267. Each relay coil is directly connected to a p-com line and to a +24 V line by a proximity switch. The proximity switches are normally closed so that the H and L relay coils are activated. When the elevator is at the proximity switch location the switch is open and the H or L relay coil connected to the switch is deactivated.

These proximity switches are opened and closed by a metal target attached to the elevator platform 12. In FIG. 3C the proximity switches are normally closed but are opened when the target is adjacent to the switch. Thus, the H and L relay coils are activated unless the associated proximity switch is opened by the target.

Figure 3D:
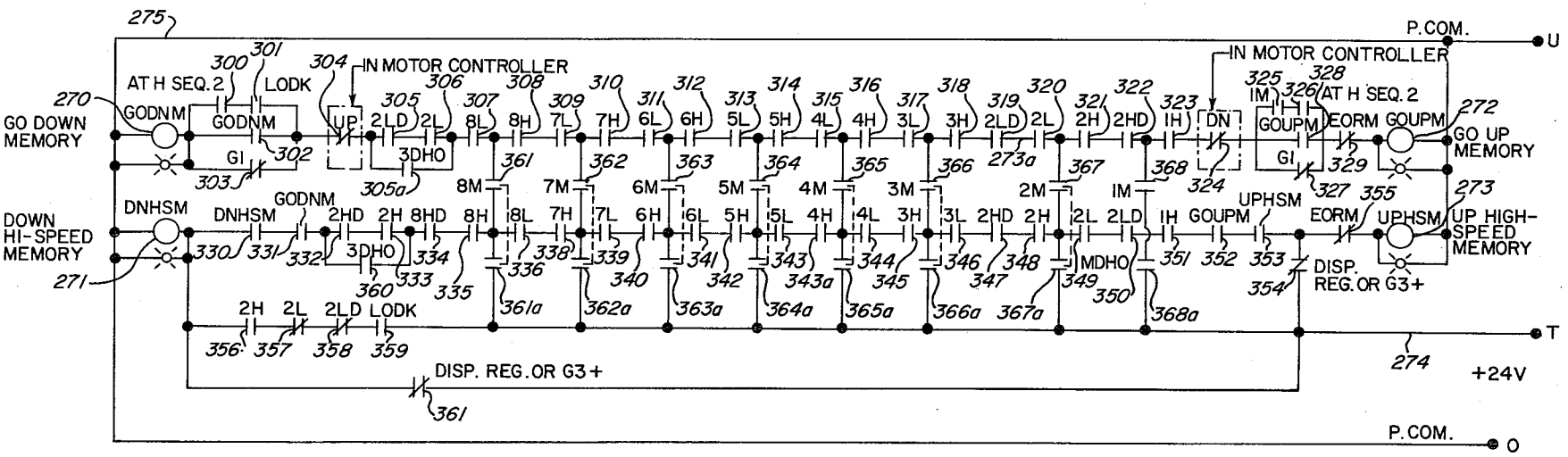

Turning next to FIG. 3D, a circuit diagram of an elevator levelling circuit is presented. The circuit includes a GODNM relay coil 270 and a GOUPM relay coil 272 connected by a first relay contacts chain **272*a* including UP and DN relay contacts 304, 324 and H and L contacts 305–323. Additionally, a DNHSM relay coil 271 is connected to a UPHSM relay coil 273 by a second relay contact chain 273*a* including H and L relay contacts 333–351. The two relay contact chains 272*a*, 273*a* are connected to each other by memory relay contacts 361–367 and are connected to an interlocked +24 V line by memory relay contacts 361*a*–367*a*. The contact chain 272*a* is connected directly to the interlocked +24 V line by contacts 368 and 368*a* in series. If the number of elevator locations is greater than that illustrated in FIG. 1 then a G3 relay or time-delay DISP REG. relay 413 (FIG. 3E**) is required because there are not enough contacts in the present circuit.

Figure 3E:
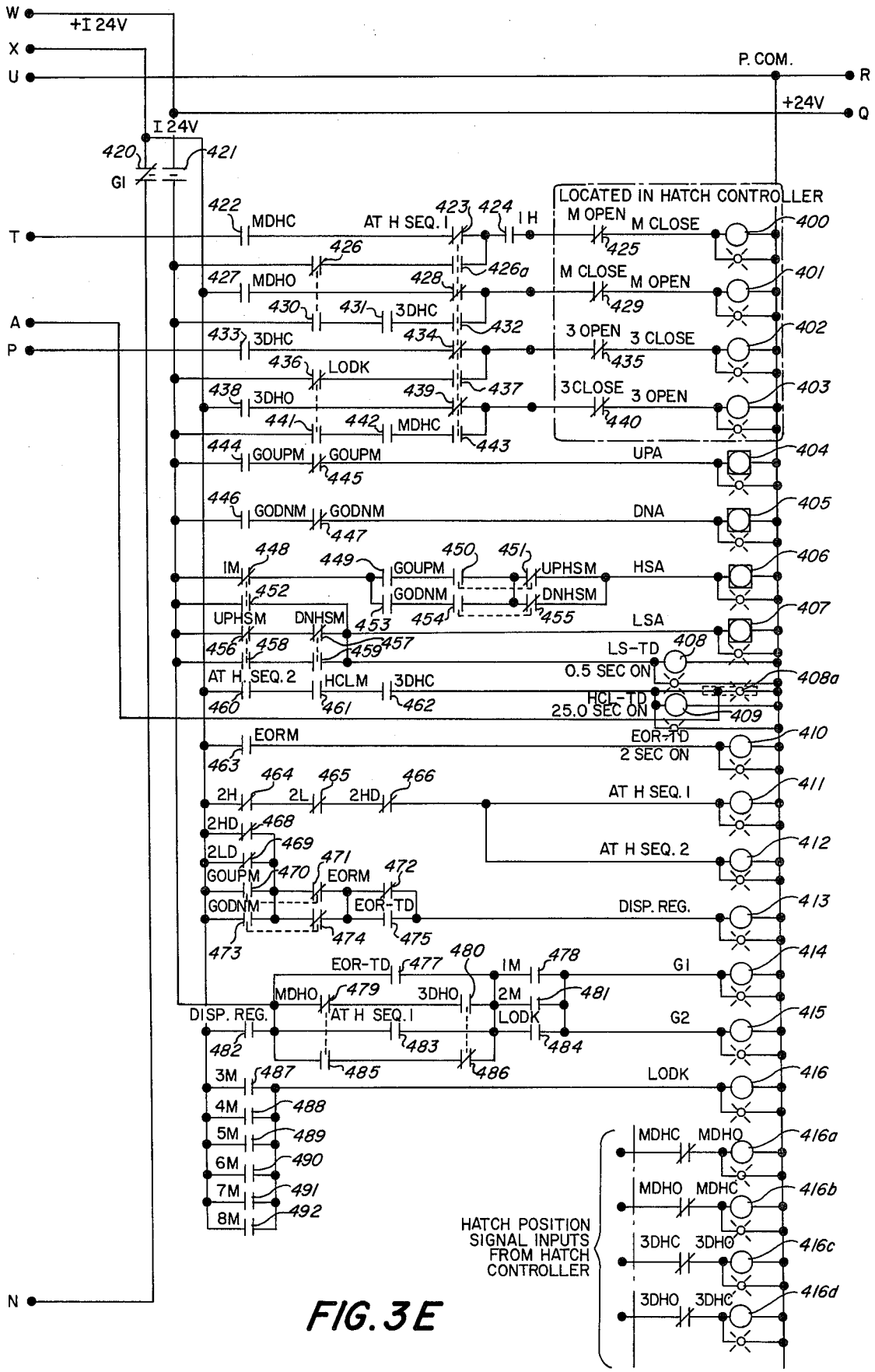

Next, FIG. 3E is a circuit diagram of the command circuit of the control unit including a plurality of relay coils **400–410, 416*a*–416*d* (the command relays) and relay contacts 420–492. Each command coil is directly connected to p-com and connected to an interlocked 24 V line by a circuit including several relay contacts interconnected in series and/or parallel. Note that Hatch Signal relays 416*a*–416*d*** receive input signals from the dual-hatch controller indicating the hatch positions.

Figure 3F:
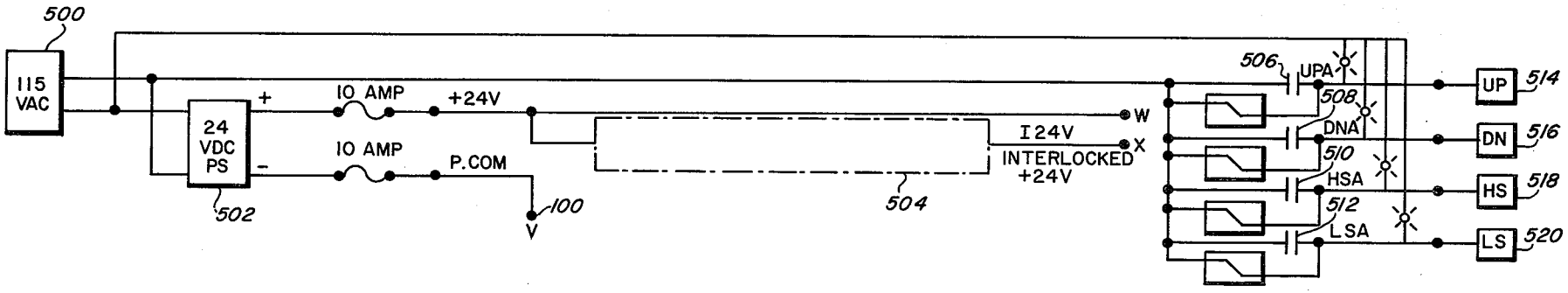

Finally, FIG. 3F depicts a circuit including 115 VAC power supply 500, a 24 VDC power supply 502, a safety interlock circuit 504, and UPA, DNA, HSA, and LSA relay contacts 506, 508, 510 and 512 for activating the UP, DN, HS and LS motor contactors 514, 516, 518 and 520, respectively. These contactors are large relays that interconnect the motor inputs to a 440 VAC motor power supply (not shown). Both the UP and DN contactors include auxiliary contacts that function as the UP and DN relay contacts 304, 324 of the elevator levelling circuit of FIG. 3D.

The p-com line is connected to the negative output of the 24 VDC power supply 502. The +24 VDC output is connected to terminals W and X. Note that terminal X is connected to the power supply positive terminal by the safety interlock circuit 504. This circuit interrupts power to the control unit thereby stopping the platform if platform over-travel, door interlock, slack cable, motor over temperature, motor over-load and other safety switches (not shown) are activated.

A description of the operation of the circuit depicted in FIGS. 3A–3F follows.

Assume that the platform 12 is positioned at the hold level 28 with the third-deck hatch cover 38 open and the main-deck hatch cover 30 closed. Closing of trunk doors and completion of safety permissive signals 504 (FIG. 3F) is outside the scope of this patent. Next the push-button for dispatch to the main-deck 110 is actuated and the order is registered in the logic. The main-deck push-button activates the "Hatch-clear memory" relay (HCLM)203, and also via HCLM contacts 230, the "Stow memory" relay (2M)204. Since the "Dispatch registered" contacts 354 and 361 (DISP. Reg.)

and the "Emergency-override memory" relay (EORM) contacts 355 are unactivated both the "Up high-speed memory" relay (UPHSM) 273 and the "Down high-speed memory" relay (DNHSM) 271 are activated. Since platform high and low leveling switches at the hold level 246, 247 and 248 are activated, input switch relays 8H, 8HD and 8L 265, 266, and 267 are unactivated and relay contacts 8H and 8L 308 and 307 are open. This results in the "Go-up memory" relay (GOUPM) 272 being activated via 2M contacts 367 and 367*a*, and the "Go-down memory" relay (GODNM) 270 being unactivated. When GOUPM is activated and GODNM is unactivated with no emergency override condition, the "Dispatch-registered" relay (DISP. REG.) 413 becomes activated. When DISP. REG. 413 becomes activated two relays are locked in memory. These are HCLM 203 so long as the "Hatch-clear time-delay" relay (HCL-TD) 409 is unactivated (contact 219 closed), and 2M 204 so long as one hatch is open as indicated by relay contacts "Main-deck hatch closed" (MDHC) 220 and "Third-deck hatch closed" (3DHC) 221. At this point the dispatch command has been registered and the main-deck push-button 110 can be released. Actuation of the DISP-REG. relay 413 results in the actuation of the "GO" relays (G1 and G2) 414 and 415 provided the third-deck hatch is open and the main-deck hatch is not opened or vice versa is indicated by relay contacts "Main-deck hatch open" (MDHO) 479 and 485, and "Third-deck hatch open" (3DHO) 480 and 486. When the platform is at the hatch sequence level as indicated by relay "At hatch-sequence #1" (At H. SEQ1) contacts 483, the GO relay remains activated even though both hatches may be closed. Finally the "Go" relay is interlocked through dispatch memory relay contacts as indicated by 1M 478, 2M 481 and "Low-deck command" (LODK) 484. When the "GO" relays switch, power is severed, via G1 relay contacts 420, to the push-button stations of the dispatch unit 52 and the memory relay inputs are isolated. Simutaneously, power is established via G1 relay contact 421 to permit platform or hatch movement (relays 400–407) and prohibit redispatch unless memory relays 1M–8M (202, 204, and 206–211, respectively) have dropped out.

A further consequence of relay DISP. REG. 413 switching is to deactivate "Down high-speed memory" relay (DNHSM) 271 while "Up high-speed memory" relay (UPHSM) 273 remains activated via 2M memory relay contacts 367*a*, input switch L and H relay contacts 349–351, and UPHSM relay contact 353. Operation of the "GO#1" relay "G1" contacts 303, 327 leaves the "Go-down memory" relay (GODNM) 270 unactaivated and the "Go-up memory" relay (GOUPM) 272 activated in such a manner that any switch actuation above the destination level would cause GOUPM 272 to fall out and stay out until a new dispatch is made. With G1 contact 421 and GOUPM contact 444 activated and GODNM contact 445 deactivated the "Up auxiliary" solid-state relay (UPA) 404 turns on. With GOUPM contact 449 and UPHSM contact 450 activated and DNHSM contact 455 and 1M contact 448 deactivated, "High-speed auxiliary" solid-state relay (HSA) 406 turns on. The platform departs upward at high-speed to the hatch sequence level where the platform slows down by activation of proximity switches 234 or 235 which operate relays 2L or 2LD 253 or 254. A short time later the platform comes to a full stop by operation of switches 232 or 233 which deactivate relays 2H or 2HD 251 or 252. The third-deck hatch cover close command is now given. Since relay LODK contact 436 is not activated and relay At H.SEQ1 contact 437 is activated, the hatch cover closes following activation of the "Third-deck hatch close command" relay DH1 (3 close) 402. Stopping the platform at the hatch sequence level and subsequent closing of the third-deck hatch cover only occurs when the platform is dispatched to the main-deck from any level including the second-deck.

If the "hatch-clear" button 102 at the main-deck recessed control station has not been depressed by the main-deck station operator in the time allowed, the platform stays at hatch sequence with both hatches closed and the memory is cancelled. The "Hatch clear" push-button 102 is enabled when relays At H.SEQ2, HCLM and 3DHC are activated and contacts 460, 461 and 462 are closed. The hatch clear push-button 102 must be depressed during the "Hatch clear time-delay" relay (HCL-TD) 409 set-time, otherwise the relay times out and cancels memory relays HCLM 203 and 2M 204, and the dispatch is cancelled.

If the "hatch-clear" permissive signal is received in the allotted time the next operation is to open the main-deck hatch cover 30. When the hatch-clear push-button 102 is depressed, memory relay 1M 202 is set. This in turn activates "Main-deck hatch open command" relay (M OPEN) 401 since interlock relays 3DHC and At H.SEQ1 are activated, and contacts 431 and 432 closed.

The dual-hatch controller provides signals from hatch position proximity siwtches to activate the coils of relays "main-deck hatch opened" MDHO 416*a*, "main-deck hatch closed" MDHC 416*b*, "Third-deck hatch opened" 3DHO 416*c*, and "Third-deck hatch closed" 3DHC 416*d*.

For purposes of ensuring that the main-deck hatch is clear, an indicator light 408*a* and a momentary contact type push-button 102 are provided at the main-deck control station. The indicator light is energized when a dispatch is registered from any level to the main-deck but only after the platform has reached the hatch sequence level and the third-deck hatch cover has been closed. This light is to indicate that a "hatch-clear" permissive signal is required by means of the push-button furnished for the purpose. Once the "hatch-clear" signal has been received by the logic it can be cancelled in case the hatch is no longer clear, and imminent danger exists, by actuation of the "Emergency-override" push-button 101. If, after arrival at the hatch sequence level, no "hatch-clear" signal has been received within the time allowed, the dispatch is cancelled and a new dispatch order will be required from the main control station at the second deck or it will be necessary to activate the "Call to main-deck" push-button 103 at the main-deck recessed control station. Actuation of the "hatch-clear" push-button 102 does not register a permissive signal to the controller unless a dispatch command to the main-deck has been received by relay 203 with subsequent operation of the indicator 408*a* requesting "hatch-clear" signal. The "Stow" memory (2M) 204 is cancelled when both the main-deck and third-deck hatches are closed unless there is a "hatch-clear-request", in which case both "Stow" and "Hatch-clear-request" 203 memories are cancelled at the end of the hatch-clear time delay. A "main-deck" command sets both the "hatch-clear-request" memory (HCLM) 203 and the "Stow" memory (2M) 204. Once the main-deck hatch cover 30 has been opened, the platform resumes its travel to its final destination at slow-speed upward from the hatch sequence position. Travel away from the main-deck shall be the reverse (except for speed) for all levels below hatch sequence and no "hatch-clear" signal is needed. The platform leaves every level in either direction at high-speed except that it travels upwards from hatch-sequence to the main-deck all the way in slow speed. For travel to the second-deck the third-deck hatch cover remains open. Only if subsequent travel to the main-deck is required, is this hatch closed but not before the platform has traveled the short distance to the hatch sequence level. When the platform is dispatched from the main-deck to a lower level, it first stops at hatch sequence to close the main-deck hatch cover and then open the third-deck hatch. Only then does the platform resume its downward travel to its destination including the second-deck. When the platform approaches every destination exept the main-deck, the speed is transferred from high to low by means of a slow-switch installed in the trunk. After traveling a short distance in slow-speed the platform stops at its destination upon the actuation of a stop-switch. Dispatch of the platform is possible only from the level at which the platform is stationed except that:

a. At the main-deck recessed control station it is possible to call the platform to the main-deck from hatch sequence.
b. At the master control station on the second-deck it is possible to;
   i. Call the platform to the second-deck from all levels including hatch sequence, but not from the main-deck, provided any platform leveling switch is activated. At "Stow", the platform must activate leveling switches 232–234 for the third-deck hatch to open.
   ii. Dispatch the platform: from hatch sequence to the main-deck. This requires "Hatch-clear-request" to be acknowledged.

In this description a command to send the platform to "Stow" is equivalent to sending the platform to "Hatch-sequence".

The "Emergency-override" (EOR) push-button 101 at the main-deck station operates upon momentary actuation as follows:

a. All dispatch orders are cancelled. Relay DISP. REG. 413 is deactived.
b. The stowage level is entered as the destination, but only after a temporary delay permitting all contactors to drop out and the main drive motor or hatch to stop moving. This is via operation of the "Emergency override time-delay" relay (EOR-TD) 410 which is activated via "Emergency override memory" relay (EORM) contacts 463.
c. The platform then decends to the hatch-sequence level (at high-speed unless a low-speed switch is activated), and stops when switches 2L or 2LD 234 or 235 are activated. When switches 2H, 2HD and 2L 232–234 at the hatch-sequence level are actuated by the platform the main-deck hatch returns to the closed position.
d. It is not possible to start the above sequence when the main-deck hatch is fully closed. This interlock is via normally-closed contacts of "Main-deck hatch closed" relay (MDHC) 193.
e. When the main-deck hatch becomes fully closed it cancels both memory relays EORM 201 and 2M 204.

The platform is now ready for a new dispatch. Except for relay switching times, when the controller is powered, there always is an activated open- or close-command for each hatch. Circuitry to reverse commands to each hatch is interlocked through the "GO#1" relay contacts 421.

A change in hatch command is possible only under the following circumstances:

a. A change of command from third-deck hatch close to third-deck hatch open is possible only when the platform is at hatch-sequence (At H.SEQ1 activated, contacts 443 closed), dispatch is for a level below "Stow" (LODK 416 activated, contacts 441 closed), and the main-deck hatch is closed (relay MDHC **416*b* activated, contacts 442** closed).
b. A change of command from third-deck hatch open to third-deck hatch close is possible only when the platform is at hatch-sequence (relay At H.SEQ1 411 activated, contacts 436 closed) and the destination is either "Stow" or "Main-deck" (relay LODK 416 deactivated, contacts 436 closed).
c. A change of command from main-deck hatch close to main-deck hatch open is possible only when the platform is at the hatch sequence level, (relay At H.SEQ 1 411 activated, contacts 432 closed), destination is to the main-deck (relay 1M 202 activated, contacts 430 closed), and the third-deck hatch is closed (relay 3DHC **416*d* activated, contacts 431** closed).
d. A change of command from main-deck hatch open to main-deck hatch close is possible only when the platform is at the hatch-sequence level (relay At H.SEQ 1 411 activated, contacts **426*a* closed), and the destination is "Stow" or levels below (relay 1M 202 is unactivated, contacts 426 closed). A safety interlock from proximity switch 231 prevents the main-deck hatch closing if the main-deck platform-leveling switch is activated (relay 1H 250 must be activated and contacts 424** closed).

To reduce the number of relay parts to be stocked, and therefore influence the supply system the least, logic circuits are configured for the acceptance of time-delay relays which are all of the delay-on-operate type. A summary of time-delay relays used is as follows:

a. "Hatch-clear time-delay" relay (HCL-TD) 409; 25–30 seconds.
b. "Low-speed time-delay" relay (LS-TD) 408; 0.5–0.6 seconds.
c. "Emergency-override time-delay" relay (EOR-TD) 410; 2.0–3.0 seconds.
d. If the number of levels does not require a G3 relay then DISP.REG. relay 413 should be time-delay; 0.3–0.4 seconds.

The following safety features apply:

a. The signal to the "Go-up memory" (GOUPM) relay coil 272 goes through the "down" motor contactor auxiliary contacts (DN)324. Similarly the signal to the "Go-down memory" relay coil (GODNM) 270 goes through the "up" motor contactor auxiliary contacts (UP) 304.
b. Only dispatch switches at command control stations from which dispatches are permissible are energized. This is via normally closed contacts 160–176 of the H and L relays.
c. An unsafe signal from sensors consists of an input into the logic control which is open, grounded or power supply common. Trunk mounted proximity switches 231–248 to sense platform motion have power supply high voltage output when the switch is not actuated by a device normally intended for that purpose. This causes the signal input relays (H and L series) to be activated for a safe condition and deactivated for an unsafe, slow or normal stop condition.

d. Dispatch orders consist of an input signal into the logic, M relays 202–211, with a potential difference from ground, chassis or common. The circuitry of the logic is so designed that no potential difference from ground or common remains on any command input lead when not energized by a push-button.

e. Duplicate proximity switches are provided at the hatch-sequence level 233 and 235, and at the lower extreme of travel 247. The duplicate switches are used as back-up for the primary switches and interrupt logic signals to the auxiliary command relays insuring that platform travel shall proceed in slow-speed or stop.

f. A safety provision is incorporated into the memory circuits which causes the cancellation of output signals to the main contactor solenoids should the high-speed contactor not drop out within a prescribed time of being commanded to do so. This circuit involves passing the logic power to the reset circuitry of the memory units through the normally-closed auxiliary contacts of the "High-speed" motor contactor (HS) 214 in parallel with normally-closed contacts of a "Low-speed time-delay" relay (LS-TD) 215. The dispatch memory 202–211 will be caused to reset if the high-speed contactor fails to drop out and the "Low-speed time-delay" relay (LS-TD) 408 in parallel with the "Low-speed auxiliary" command relay (LSA) 407 times out and energizes. This resetting of the dispatch memory deactivates GODNM and GOUPM coils 275, 272 because the M contacts 361–368 are opened. Consequently, GODNM and GOUPM contacts 446 and 444 are opened and UPA and DNA relay coils 404 and 405 are inactivated. The motor controller is wired so that both the HS contactor and an UP or DN contactor must be activated for the platform to move.

g. The elevator is permitted to start just once in high-speed on each dispatch; except that there is an automatic high-speed reset at hatch-sequence when the platform is proceeding to levels below from a dispatch which originated at the main-deck. This safety feature is to prevent the logic from switching back into high-speed after the platform has been traveling in low-speed if, for example, a stop switch should fail and the platform travels to a section of the trunk clear of any leveling switches. It is accomplished by interlocking relays UPHSM and DNHSM 273 and 271 as memory units via their own contacts 353 and 330.

h. When the platform is dispatched to an intermediate level, all slow-and stop-switches beyond the destination in the direction of travel act to slow the platform and bring it to a stop in case the switches at the intermediate level fail to do so. This is particularly important at the stowage level when the platform travels upward to prevent the platform from running into the closed maindeck hatch cover. This feature is achieved by the use of L and H relay contacts 305–323 and 332–351 in the input signals to relays GOUPM, UPHSM, GODNM and DNHSM 272, 273, 270 and 271.

In actual use, several modifications of the above-described circuit may be necessary due to varying system requirements. Specifically:

(a) If platform stopping levels are disposed so closely together that the high and low proximity switches associated with the respective platform levels overlap (e.g. platform forward 26 and second platform aft 27) then the relay contact chains for GOUPM 272 and GODNM 270 must be separated. This is to prevent the elevator platform, when going down for example, from stopping prematurely at the H switch for the level below that desired.

(b) For reasons of standardization it has been required in some cases to use proximity switches in the location sensing unit that are closed by the target so that the associated H and L relays are normally unactivated. One particular embodiment utilizes duplicate switches that are opened by the target but utilizes switches that are closed by the target elsewhere.

(c) The electromechanical relays described above may be replaced by all-solid-state relays.

Obviously, numerous (additional) modifications and variations of the present invention are possible in light of the above teachings. It is therefore to be understood that within the scope of the appended claims, the invention may be practiced otherwise than as described herein.

What is claimed and desired to be secured by Letters Patent of the United States is:

1. An elevator leveller/hatch controller logic circuit of the type for automatically positioning an elevator platform, said circuit having platform up, down, high-speed and low-speed outputs, connected to an elevator motor controler, for controlling the motion of said elevator platform, said elevator platform located in an elevator trunk having first and second hatches associated therewith, said first and second hatches being coupled to a dual-hatch controller, said circuit comprising:

first means for dispatching the elevator platform to a desired destination, said first means including a plurality of destination dispatch outputs;

second means for sensing the location of said elevator, said second means with a plurality of location sensing outputs; and control means interconnected with said first means, said second means, said dual-hatch controller, and said motor controller, for slowing and stopping the platform if it proceeds beyond the desired destination, for activating the high speed controller only once per dispatch, for enabling the elevator platform to be dispatched only to preselected locations, and for controlling said first and second hatches such that said first and second hatches are not simultaneously open.

2. The circuit recited in claim 1 wherein:

said circuit includes hatch open and hatch close outputs connected to said dual-hatch controller for opening and closing said first and second hatches covering the elevator trunk; and said control means further includes means for opening and closing said first and second hatchs in response to elevator platform location.

3. The circuit recited in claim 1 wherein:

said first means includes a plurality of dispatch switches at a first location for dispatching the elevator platform to a second location and further includes means for activating only those dispatch switches that dispatch the platform to preselected locations.

4. The circuit recited in claim 3 wherein:

said second means includes a high and a low proximity switch at each elevator location.

5. The circuit recited in claim 4 wherein:

each of said high proximity switches is connected to an H relay coil and each of said low proximity switches is connected to an L relay coil.

6. The circuit recited in claim 5 wherein:

said dispatch switch activation means includes a plurality of L and H relay contacts interconnected with said dispatch switches.

7. The circuit recited in claim 6 wherein:

said control means includes a plurality of M relay coils wherein each of said M relay coils is interconnected with one of said dispatch switches.

8. The circuit recited in claim 7 wherein:

said control means includes a plurality of H, L and M relay contacts, activated by said H, L and M relay coils, interconnected with a plurality of control relay coils, said control relay coils for controlling a plurality of relay contacts that activate or inactivate the inputs of the dual-hatch controller and motor controller.

9. An elevator leveller/hatch controller logic circuit of the type for automatically positioning an elevator platform and for closing a first and second hatch covering the elevator trunk in response to platform position, said circuit with first and second hatch open and close outputs, connected to the respective inputs of a dual-hatch controller, for opening and closing said first and second hatches, and with platform up, down, high-speed and low-speed outputs, connected to the respective inputs of an elevator motor controller, for controlling the motion of said elevator platform, said circuit comprising:

an elevator dispatch unit including a plurality of dispatch switches at each elevator location for dispatching said elevator to a desired destination;

an elevator location sensing system including a low position (L) proximity switch and a high position (H) proximity switch at each elevator location for sensing the location of said elevator platform, wherein each of said L proximity switches is connected to an L relay coil and each of said H proximity switches is connected to an H relay coil;

a control unit including a plurality of M relays coils energized by said dispatch switches for activating a plurality of M relay contacts, a plurality of H and L relay contacts activated by said H and L relay coils, and a plurality of control relay coils, interconnected with said H,L and M relay contacts, for activating a plurality of control relays, each up (UPA), down (DNA), high speed (HSA), and low speed (LSA) input of the motor controller being activated by an UPA, DNA, HSA and LSA control relay contact respectively, each first hatch open and close input of the dual-hatch controller being activated by a first hatch open control relay contact and a first hatch close control relay contact respectively, and each second hatch open and close input being activated by a second hatch open control relay contact and a second hatch close control relay contact respectively, said relays and relay coils in said control unit being interconnected for closing either the first hatch or the second hatch in response to platform position, for inactivating all inputs to the motor controller when the platform arrives at or proceeds beyond its destination, for activating the HS input of the motor controller only once per dispatch and for activating only preselected dispatch switches.

10. The circuit recited in claim 9 wherein:

said control unit include means for opening said UPA and DNA relay coils activating the respective motor controller inputs if the high speed contactor in the motor controller fails to drop out within a prescribed time after the HSA relay contact opens.

11. The circuit described in claim 9 wherein:

said relays are electromechanical relays.

12. The circuit recited in claim 9 wherein:

said relays are solid-state relays.

* * * * *